United States Patent [19]

Yasuhara

[11] 4,368,706

[45] Jan. 18, 1983

[54] DISTRIBUTOR-TYPE FUEL INJECTION PUMP GOVERNOR

[75] Inventor: Seishi Yasuhara, Yokosuka, Japan

[73] Assignee: Nissan Motor Co., Ltd., Yokohama, Japan

[21] Appl. No.: 150,526

[22] Filed: May 16, 1980

[30] Foreign Application Priority Data

May 21, 1979 [JP] Japan ..... 54-66800[U]

[51] Int. Cl.[3] ..... F02D 1/04

[52] U.S. Cl. ..... 123/370; 123/371; 123/388

[58] Field of Search ..... 123/387, 364, 365, 449, 123/370, 371, 388

[56] References Cited

U.S. PATENT DOCUMENTS 3,946,713 3/1976 Laufer ..... 123/387

*Primary Examiner*—Charles J. Myhre

*Assistant Examiner*—Andrew M. Dolinar

*Attorney, Agent, or Firm*—Thompson, Birch, Gauthier & Samuels

[57] ABSTRACT

A governor sleeve is axially displaceable on a stationary governor shaft and has an inner space which is adjoined by the governor shaft and which communicates with the inner chamber of a pump housing charged with fuel. The inner space varies in volume drawing thereinto and discharging therefrom fuel in response to axial displacement of the governor sleeve. According to the present invention, there is provided a helical groove which is formed in the outer cylindrical surface of the governor shaft or the inner cylindrical surface of the governor sleeve. Such groove effects a forced fuel conveying action of forcedly, though yieldingly, conveying fuel from the inner chamber to the inner space, which is effective in preventing an acceleration jerk and smoky exhaust upon rapid engine acceleration.

10 Claims, 6 Drawing Figures

DISTRIBUTOR-TYPE FUEL INJECTION PUMP GOVERNOR

BACKGROUND OF THE INVENTION

This invention relates in general to distributor-type fuel injection pumps for compression ignition internal combustion engines or Diesel engines and more particularly to governors of such fuel injection pumps.

In FIG. 1, there is shown a prior art distributor-type fuel injection pump for a compression ignition multicylinder internal combustion engine.

The prior art distributor-type fuel injection pump comprises a pump housing 1 having an inner chamber 1*a* which is charged with fuel by a fuel supply pump (not shown). To the pump housing 1 there is fixedly attached a plunger barrel 2 in which is mounted a distributor plunger 3. The distributor plunger 3 is powered by engine-driven power transmitting means (not shown) and reciprocates while rotating to effect pumping and distributing actions.

During the suction stroke or leftward stroke of the distributor plunger 3, fuel is drawn from the inner chamber 1*a* through an inlet channel 4 and longitudinal grooves 5 provided in the outer face of a terminal portion of the distributor plunger 3 to a pump work chamber 6 which is adjoined by the distributor plunger 3. During the pressure stroke or rightward stroke of the distributor plunger 3, fuel under pressure is delivered from the pump work chamber 6 through a distributor channel 7 to one of outlet channels (only one is shown). Therefrom fuel is delivered through the associated one of delivery valves 9 to one of injection nozzles (not shown). In this manner, fuel is sequentially injected into the cylinders of the engine.

In the distributor plunger 3 there is provided a transverse channel or relief channel 10 which cooperates with a control sleeve 11. The control sleeve 11 is axially displaceable on the distributor plunger 3 to seal and unseal the mouths of the relief channel 10 in the outer surface of the distributor plunger 3. When the control sleeve 11 unseals or uncovers the mouths of the relief channel 10, the pump work chamber 6 is drained into the inner chamber 1*a* of the pump housing 1 to terminate the fuel delivery to the injection nozzles. Hence it is possible to alter the terminal moment of fuel delivery during each pressure stroke of the distributor plunger 3 and therefore the quantity of fuel delivered to the engine by changing the position of the control sleeve 11. For example, leftward displacement of the control sleeve 11 in the drawing results in reduced injected fuel quantity.

The axial position of the control sleeve 11 is controlled by a governor mechanism which comprises a governor shaft 12 which is fixedly attached to the pump housing 1. On the governor shaft 12 there is rotatably mounted a centrifugal weight holder 13. The holder 13 is powered by the aforementioned power transmitting means (not shown) for the distributor plunger 3 by way of a multiplying gear (also not shown). On the centrifugal weight holder 13, centrifugal weights 14 are supported and rotated about the governor shaft 12 and swing outwardly due to centrifugal force. As the weights swing outwardly, fingers 14*a* axially displace a governor sleeve 15on the governor shaft 12, in the rightward direction in the drawing. The governor sleeve 15 abuttingly engages at the left-hand end thereof with the upper arm portion of a starting lever 16 which is swingably supported on a pivot 17. The lower arm portion of the starting lever 16 has a spherical terminus 16*a* which extends into a depression of the control sleeve 11 for causing axial displacement of the control sleeve. On the pivot 17 there is also swingably supported a tensioning lever 18. Between the tensioning lever 18 and the starting lever 16 there is interposed a starting spring or an excess fuel spring 19 in the form of a leaf spring. The tensioning lever 18 is operatively connected through an idle spring 20, a governor main spring 21 and a control lever 22 to an accelerator pedal (not shown). Stopper 23 limits the extent of counterclockwise swing of the tension lever 18.

The operation of the governor mechanism thus described will be explained hereinbelow with additional reference to FIG. 2.

When the engine is stopped and therefore the centrifugal weights 14 are motionless, the centrifugal weights 14 assume the completely closed condition due to the bias of the starting spring 19 transmitted thereto by way of the starting lever 16 and at the same time control sleeve 11 is moved into the starting position or the most rightward position thereof (represented by the horizontal line A in the graph of FIG. 2) in the drawing (FIG. 1) whereby an excess fuel quantity required by the engine during starting is obtained.

When the engine starts and in the absence of depression on the accelerator pedal, the control lever 22 is put into the idle position and therefore the tension of the governor spring 21 reduces approximately to zero. The centrifugal weights 14 are thus permitted to swing outwardly even in the relatively low rotational conditions thereof which displaces the governor sleeve 15 rightwardly turning the starting lever 16 together with the tension lever 18 and compressing both the starting spring 19 and the idle spring 20, resulting in the movement of the control sleeve 11 leftwardly into the idle position which is determined by the balance of the centrifugal force and the biasing forces of the starting spring 19 and the idle spring 20. In this manner, the quantity of fuel necessary for smooth idling of the engine is obtained as represented by the point B in the graph of FIG. 2.

When the accelerator pedal is then depressed to move the control lever 22 to some extent, the tension of the governor main spring 21 becomes larger and consequently both the starting spring 19 and the idle spring 20 are compressed to be of shorter length permitting the tension lever 18 to swing counterclockwise until it abuttingly engages the stopper 23. Actuated by such swing of the tension lever 18, the starting lever 16 displaces the control sleeve 11 to the full load position as is represented by the point C in the graph of FIG. 2. The control sleeve 11 remains thereat permitting the engine speed to increase up to the value as is represented by the point D in the graph of FIG. 2 where the centrifugal weights 14 start to displace the governor sleeve 15 overcoming the counter force thereto. After that, the control sleeve 11 is displaced in the fuel-increasing direction, i.e., leftwardly to the position as represented by the point E in the graph of FIG. 2 which is determined by the balance of the centrifugal force of the centrifugal weights 14 and the biasing forces of the springs 19, 20 and 21. The engine speed is thus controlled with relation to the amount of depression on the accelerator pedal.

The pivot 17 is carried on a full load fuel quantity adjusting lever 24 which is pivotally supported on a stationary pivot 25. The adjusting lever 24 is normally held stationary but is caused to swing about the stationary pivot 25 by rotating a screw 26 to change the setting of the full load fuel quantity. A fuel-cut solenoid valve 27 is provided for stopping the engine.

The governor sleeve 15 has an inner space 30 which is adjoined by an end of the governor shaft 12 and which varies in volume in response axial displacement of the governor sleeve on the governor shaft. In order to draw fuel from the inner chamber 1*a* of the pump housing 1 into the inner space 30 and on the other hand to discharge fuel from the inner space 30 into the inner chamber 1*a* in response to the variation in volume of the inner space 30, there is provided in the governor sleeve 15 an opening P which provides communication between the inner space 30 and the inner chamber 1*a*. The flow passage sectional area of the opening P has heretofore been designated to be relatively large for the reason of good responsiveness.

Though the prior art distributor-type fuel injection pump with such a governor mechanism produces good results upon engine deceleration due to the good responsiveness, it tends to produce undesirable results upon rapid engine acceleration due to the good responsiveness. That is, upon rapid engine acceleration, the control lever 22 actuates, by means of the governor main spring 21, the starting lever 16 toether with the tension lever 18 to rapidly swing in the counterclockwise direction displacing the governor sleeve 15 leftwardly in the drawing. In response to such displacement of the governor sleeve 15, the control sleeve 11 is rapidly displaced rightwardly or in the fuel-increasing direction. As a result, the quantity of fuel delivered to the engine increases rapidly, resulting in an acceleration jerk which prevents good drivability and causes a smoky exhaust emission from the engine. This occurs because, at the initial stage of the rapid engine acceleration, the rate of engine air flow can not quickly increase so as to match the increased quantity of fuel delivered to the engine, that is, the increase in the rate of engine air flow lags behind the increase in the quantity of fuel delivered to the engine.

OBJECTS OF THE INVENTION

It is accordingly an object of the present invention to provide a distributor-type fuel injection pump with an improved governor mechanism which is free from the foregoing drawbacks inherent in the prior art comparable fuel injection pump.

It is another object of the present invention to provide a distributor-type fuel injection pump of the above described character which is constructed to prevent an acceleration jerk upon rapid engine acceleration.

It is a further object of the present invention to provide a distributor-type fuel injection pump of the above described character which is constructed to prevent smoky exhaust emission from a Diesel engine upon rapid engine acceleration.

It is a yet a further object of the present invention to provide a distributor-type fuel injection pump of the above described character which is constructed to prevent noxious exhaust emissions from the engine upon rapid engine acceleration.

BRIEF DESCRIPTION OF THE DRAWINGS

The features and advantages of the present invention will become more apparent from the following description taken in conjunction with the accompanying drawings, in which.

DESCRIPTION OF THE PREFERRED EMBODIMENTS

Figure 1:
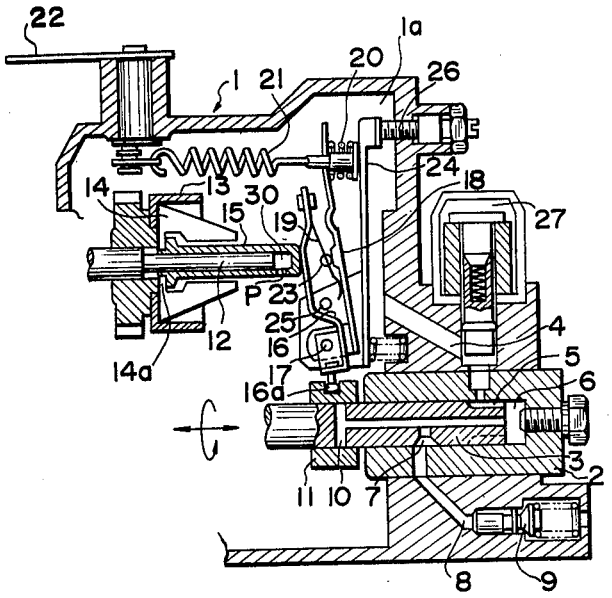
FIG. 1 (PRIOR ART)
FIG. 1 is a sectional view partly broken away showing a prior art distributor-type fuel injection pump with which the present invention is concerned.
Figure 2:
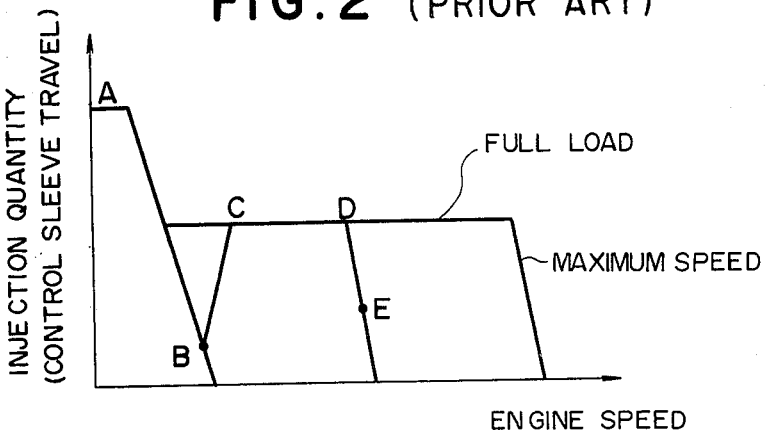
FIG. 2 (PRIOR ART)
FIG. 2 is a graph showing the operation characteristics of the governor mechanism of the fuel injection pump of FIG. 1.
Figure 3A:
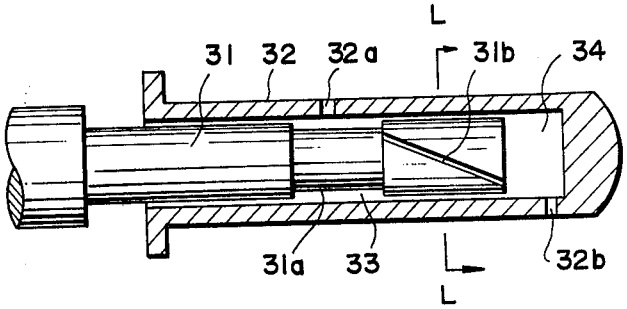
FIG. 3A is a fragmentary sectional view showing part of a governor mechanism of a distributor-type fuel injection pump embodying the present invention.
Figure 3B:
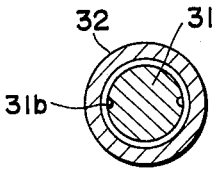
FIG. 3B is a cross sectional view taken approximately along line L—L of FIG. 3A.

Referring to FIGS. 3A and 3B, part of a governor mechanism according to one embodiment of this invention is shown. The omitted part of the governor mechanism is substantially similar to the prior art governor mechanism of FIG.1. A governor shaft 31 has a reduced diameter neck section 31*a* which is located approximately at the middle of the governor sleeve carrying portion thereof. A governor sleeve 32 is rotatably and axially displaceably carried on the governor shaft 31 and cooperates with the neck section 31*a* to define therebetween an annular space 33. The governor sleeve also has an inner space 34 which is adjoined by an end of the governor shaft 31. The governor shaft 31 is formed with a groove 31*b* in the outer cylindrical surface of the end section thereof between the inner space 34 and the neck section 31*a*. The groove 31*b* is a helical groove of the kind that recedes from an observer while twisting in the direction opposite to the rotational direction of the governor sleeve 32 which is observed from the end thereof nearer to the inner space 34. That is, in the case where the governor sleeve 32 is adapted to rotate counterclockwise when viewed from the right-hand side thereof in the drawing, the groove 31*b* is formed into a right-handed helical shape.

The governor sleeve 32 is formed with a first radial opening 32*a* which provides communication between the annular space 33 and the inner chamber 1*a* of the pump housing 1 (FIG. 1) and a second radial opening 32*b* which provides communication between the inner space 34 and the inner chamber 1*a*. The second opening 32*b* has a flow passage cross sectional area smaller than that of the first opening 32*a*.

The operation of the distributor-type fuel injection pump with an improved governor mechanism thus described according to the present invention will be explained hereinbelow.

When the governor sleeve 32 is axially stationary while rotating on the governor shaft 31, such circulation of fuel occurs that a portion of the fuel contained in the inner chamber 1*a* of the pump housing flows through the opening 32*a* into the annular space 33 and therefrom through the helical groove 31*b*, the inner space 34 and the opening 32*b*, in sequence, back to the inner chamber 1*a*. This is due to the provision of the helical groove 31*b*, that is, the helical groove 31*b* effects a forced fuel conveying action of forceably, though yeildingly, conveying fuel from the annular space 33 to the inner space 34 upon rotation of the governor sleeve 32.

Upon engine acceleration, the governor sleeve 32 is actuated by the tension lever 18 and the starting lever 16 to be displaced leftwardly in the drawing. In this instance, as the governor sleeve 32 is increasingly displaced in the leftward direction, a quantity of fuel contained in the inner space 34 increasingly flows out therefrom through the opening 32*b* and the flow path comprised of the groove 31*b*, the annular space 33 and the opening 32*a*. However, since such outflow of fuel from the inner space 34 is restricted or limited by the forced fuel conveying action of the groove 31*b* and the opening 32*b* of a relatively small flow passage cross sectional area, the governor sleeve is displaced relatively slowly or insensitively in the leftward direction to increase the quantity of fuel to the engine for injection.

Upon engine deceleration, the centrifugal weights 14 are swung outwardly causing the governor sleeve 32 to be displaced rightwardly in the drawing. In this instance, as the governor sleeve 32 is increasingly displaced rightwardly, a portion of the fuel contained in the inner chamber 1*a* increasingly flows into the inner space 34 through the opening 32*b* and the flow path comprised of the opening 32*a*, the annular space 33 and the groove 31*b*. In this instance, since an increased quantity of fuel flows into the inner space 34 for a given time due to the forced fuel conveying action of the helical groove 31*b*, the governor sleeve 32 is displaced quite quickly or sensitively in the rightward direction to increase the quantity of fuel to the engine for injection.

By foregoing, there has been provided a distributor-type fuel injection pump with an improved governor mechanism which relatively quickly responds to the demand for engine deceleration and which responds relatively slowly to the demand for engine acceleration, preventing an acceleration jerk and a smoky exhaust.

Figure 4:
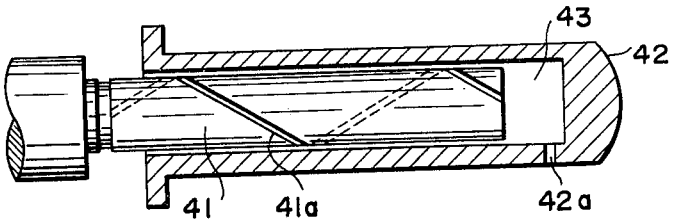
FIG. 4 is a view similar to FIG. 3A but showing another embodiment of the invention.

Referring to FIG. 4, wherein another embodiment of the invention is shown, it will be seen that a governor shaft 41 has a governor sleeve carrying portion of a substantially uniform cross section and a helical groove 41*a* which is formed in the outer cylindrical surface of the governor sleeve carrying portion. The helical groove 41*a* is of such length as to extend throughout the axial length of the governor sleeve carrying portion and have an exposed end which opens into the inner chamber 1*a* of the pump housing 1. A governor sleeve 42 is formed with an opening 42*a* which provides communication between the inner space 43 and the inner chamber 1*a*. The other structure of this embodiment is identical with that described in conjunction with FIGS. 3A and 3B.

With this FIG. 4 arrangement, since opening 32*a* and neck section 31*a* which were required in the FIG. 3 embodiment can be dispensed with, a simplified structure of a governor mechanism results. Otherwise, the action is identical with that described in conjunction with FIGS. 3A and 3B.

Figure 5:
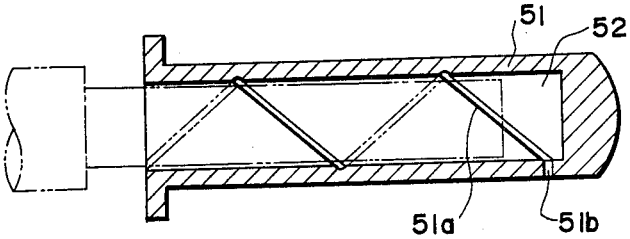
FIG. 5 is a view similar to FIGS. 3A and 4 but showing a further embodiment of the invention.

As an alternative to forming the helical groove in the outer cylindrical surface of the governor shaft as in the previous embodiments, the helical groove may be formed in the inner cylindrical surface of the governor sleeve as shown in FIG. 5. In the embodiment of FIG. 5, a governor sleeve 51 has a helical groove 51*a* which is formed in the inner cylindrical surface thereof for sliding engagement with a governor shaft and which extends nearly throughout the axial length of the inner cylindrical surface so as to open at the opposite ends thereof into the inner chamber 1*a* and an inner space 52 defined within the governor sleeve, respectively. Unlike the previous embodiments, the helical groove 51*a* in this case is of the kind that recedes from an observer while twisting in the direction corresponding to the rotational direction of the governor sleeve 51 which is observed from the end thereof nearer to the inner space 52. That is, in the case where the governor sleeve 51 is adapted to rotate counterclockwise when viewed form the right-hand side thereof in the drawing, the helical groove 51*a* is formed into a left-handed helical shape. The governor sleeve 51 is also formed with an opening 51*b* providing communication between the inner space 52 and the inner chamber 1*a*.

This embodiment of FIG. 5 produces substantially the same effect as the previous embodiments.

In each foregoing embodiment, it will be understood that a desired response characteristic of the governor mechanism is obtained by suitably determining the flow passage cross sectional area and the helical form of the groove 31*b*, 41*a* or 51*a* and/or by determining the bore size of the opening 32*b*, 42*a* or 51*b*.

By the foregoing, there has been provided an improved governor mechanism of a distributor-type fuel injection pump calculated to fulfill the objects hereinabove set forth and while preferred embodiments have been illustrated and described in detail hereinabove, various additions, substitutions, modifications and ommissions may be made thereto without departing from the spirit of the invention as encompassed by the appended claims.

What is claimed is:

1. In a distributor-type fuel injection pump for an internal combustion engine, including:

a pump housing having an inner chamber charged with fuel;

means forming a pump work chamber in communication with said inner chamber;

a distributor plunger adjoining said pump work chamber and delivering a quantity of fuel to said engine for injection during each pressure stroke, said distributor plunger having a relief channel in communication with said pump work chamber;

a control sleeve mounted on said distributor plunger for controlling said relief channel; and a governor mechanism controlling the axial position of said control sleeve to vary said quantity of injected fuel by changing the terminal moment of fuel delivery during each pressure stroke of said distributor plunger, said governor mechanism having a stationary governor shaft, a governor sleeve axially displaceable on said governor shaft and having an inner space adjoined by said governor shaft and in communication with said inner chamber, centrifugal weights mounted for rotation about said governor shaft and mounted to swing outwardly displacing said governor sleeve in the direction to produce expansion of said inner space, and coupling means providing operative connection between said control sleeve and said governor sleeve;

whereby said control sleeve is displaced in the direction to increase said quantity of injected fuel in response to displacement of said governor sleeve in the direction to produce contraction of said inner space;

the improvement therein comprising forced fuel conveying means actuated by rotation of said governor sleeve and yieldingly forcing fuel to flow into said inner space, said forced fuel conveying means comprising a helical passageway defined by said governor shaft and said governor sleeve.

2. The improvement in a distributor-type fuel injection pump as claimed in claim 1, in which said forced fuel conveying means comprises a helical groove formed in the outer cylindrical surface of said governor shaft, said helical groove cooperating with the inner cylindrical surface of said governor sleeve to define said helical passageway.

3. The improvement in a distributor-type fuel injection pump as claimed in claim 1, in which said forced fuel conveying means comprises a helical groove formed in the inner cylindrical surface of said governor sleeve, said helical groove cooperating with the outer cylindrical surface of said governor shaft to define said helical passageway.

4. The improvement in a distributor-type fuel injection pump as claimed in claim 2, in which said helical groove has a shape such that it recedes from an observer while twisting in the direction opposite to the rotational direction of said governor sleeve which is observed from the end thereof nearer to said inner space.

5. The improvement in a distributor-type fuel injection pump as claimed in claim 3, in which said helical groove has a shape that it recedes from an observer while twisting in the direction ocorresponding to the rotational direction of said governor sleeve which is observed from the end thereof nearer to said inner space.

6. The improvement in a distributor-type fuel injection pump as claimed in claim 2, further comprising:

said governor sleeve having a reducd diameter neck section which cooperates with said governor sleeve to define therebetween an annular space;

said helical groove extending from said annular space to said inner space; and said governor sleeve having a first opening providing communication between said annular space and said inner chamber.

7. The improvement in a distributor-type fuel injection pump as claimed in claim 6, in which said governor sleeve is formed with a second opening providing communication between said inner space and said inner chamber, and in which said second opening is of a flow passage cross sectional area smaller than that of said first opening of said governor sleeve.

8. The improvement in a distributor-type fuel injection pump as claimed in claim 2, in which said governor shaft has a governor sleeve carrying portion of a substantially uniform cross section and in which said helical groove extends throughout the axial length of the governor sleeve carrying portion and has a first end which opens into said inner chamber and has a second end which opens into said inner space.

9. The improvement in a distributor-type fuel injection pump as claimed in claim 3, in which said helical groove extends through the axial length of said inner cylindrical surface of said governor sleeve so as to open at the opposite ends thereof into said inner chamber and said inner space, respectively.

10. The improvement in a distributor-type fuel injection pump as claimed in claim 8 or 9, in which said governor sleeve is formed with an opening which provides communication between said inner space and said inner chamber.

* * * * *

UNITED STATES PATENT AND TRADEMARK OFFICE

CERTIFICATE OF CORRECTION

PATENT NO. : 4,368,706

DATED : January 18, 1983

INVENTOR(S) : Seishi Yasuhara

It is certified that error appears in the above-identified patent and that said Letters Patent are hereby corrected as shown below:

Claim 5, Column 7, line 33, after "shape", insert --such--;
line 34, delete "ocorresponding" and insert --corresponding--.

Claim 6, Column 8, line 3, delete "reducd" and insert --reduced--.

Signed and Sealed this

*Seventeenth* Day of *May 1983*

[SEAL]

*Attest:*

DONALD J. QUIGG

*Attesting Officer*

*Acting Commissioner of Patents and Trademarks*